United States Patent [19]

Riesen

[11] Patent Number: 4,653,545

[45] Date of Patent: Mar. 31, 1987

[54] PROJECTILE GUIDE FOR A WEAVING MACHINE

[75] Inventor: Peter Riesen, Elgg, Switzerland

[73] Assignee: Sulzer Brothers Limited, Winterthur, Switzerland

[21] Appl. No.: 846,959

[22] Filed: Apr. 1, 1986

[30] Foreign Application Priority Data

May 3, 1985 [EP] European Pat. Off. ..... 85810200.7

[51] Int. Cl.[4] ..... D03D 49/66

[52] U.S. Cl. ..... 139/188 R; 139/439

[58] Field of Search ..... 139/188 R, 192, 438, 139/439

[56] References Cited

U.S. PATENT DOCUMENTS

| | | | |
|---|---|---|---|
| 2,699,185 | 1/1955 | Pusateri | 139/188 |
| 3,075,560 | 1/1963 | Pfarrwaller | 139/188 |
| 3,556,163 | 1/1975 | Pfarrwaller | 139/188 |
| 4,593,724 | 6/1986 | Pfarrwaller | 139/188 |

*Primary Examiner*—Henry S. Jaudon

*Attorney, Agent, or Firm*—Kenyon & Kenyon

[57] ABSTRACT

The projectile guide employs support teeth which have horizontally disposed support surfaces for slidably receiving and supporting a picked projectile thereon. In addition, alternately arranged guide teeth are provided to define a picking tunnel while also providing a lateral guide on one side of the horizontal support surfaces to prevent sliding off of a projectile thereat. A lateral guide surface may also be provided on the support teeth on one side of the support surface to prevent lateral movement from an opposite side of the support surface.

10 Claims, 11 Drawing Figures

PROJECTILE GUIDE FOR A WEAVING MACHINE

Figure 1:
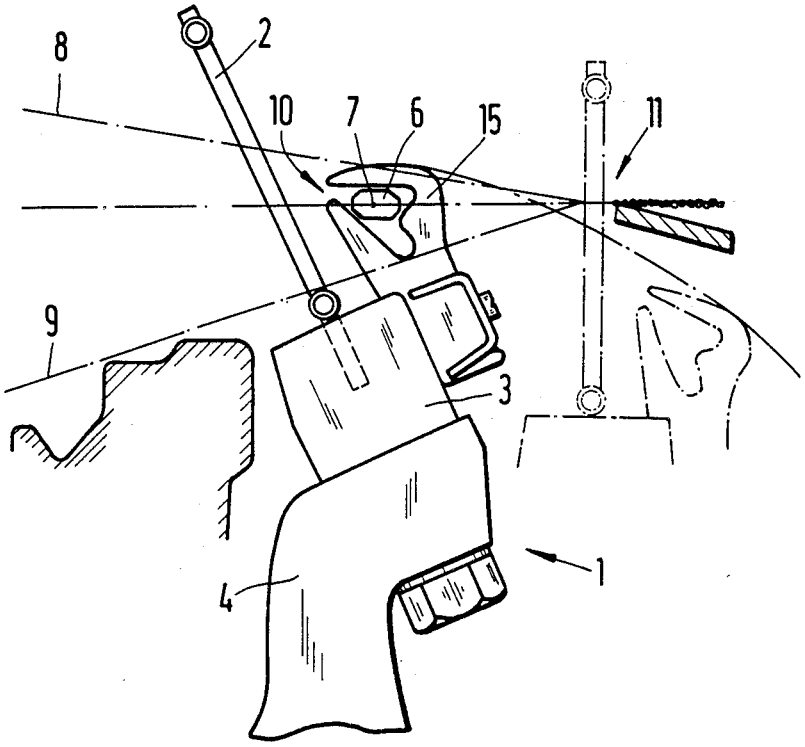
Fig. 1 PRIOR ART

This invention relates to a projectile guide for a weaving machine.

Heretofore, various types of guides have been known for use in a projectile weaving machine and particularly weaving machines which employ gripper projectiles. In some cases, the guides have been constructed of a plurality of guide teeth which are shaped to define a picking tunnel through which a picking element, such as a projectile, may be picked. Generally, the guide teeth have been formed with a plurality of surfaces for guiding of a projectile whereas, in other cases, an alternating arrangement of support teeth and guide teeth have been used to define the guide surfaces for the projectile. In addition, the guide teeth have been constructed to provide an aperture on the reed side of the guide in order to permit release of a picked weft yarn before the reed beats the yarn into a cloth.

German Pat. No. 1,801,044 filed Oct. 4, 1968 describes a projectile guide which employs two bottom inclined guide surfaces and one top horizontal guide surface for guiding a projectile during picking through a shed. However, the inclined arrangement of the bottom guide surfaces leads to support forces which are considerably more than the weight of the projectile. For example, if these surfaces are inclined at an angle of 45 degrees to a horizontal, the sum of the support forces, and, in a first approximation, the sum of the friction forces is some 40% more than when the projectile is supported on a surface normal to the direction in which the weight acts. Further, when the sley on which the guide is mounted vibrates around the pivot point of the sley, the effect of the inclined guide surfaces is to throw the projectile from one bottom guide surface to the other and back with the projectile possibly striking the top horizontal guide because of the unsteady flight of the projectile with continuously changing impact positions on the guide surfaces and because of the associated friction forces, an elaborate lubrication system must be provided for an accurately metered supply of lubricant to the weft tunnel if wear of the tunnel is to be obviated.

In another known projectile guide, as described in Swiss Pat. No. 439,159, closed guide projections have a guide surface which extends transversely to the forces associated with projectile weight. The forces with which such projections react on the projectile are less in this case, so that the friction between the projectile and the guide is also less. However, a disadvantage of this guide has been found to be that when the guide dips into the shed, with the guide teeth penetrating through the bottom warp plane with their opening at the front, discrete warp yarns may penetrate into the interior of a guide projection. Thus, there is a risk that the warp yarns may be damaged or severed between the projectile and a guide projection. This risk is particularly great near the weaving edge where, because of the shrinkage or contraction of many woven fabrics, the warp yarns do not extend parallel to the guide projections.

Accordingly, it is an object of the invention to provide an improved projectile guide for a weaving machine.

It is another object of the invention to reduce the risk of warp yarn breakages by a projectile guide during a weaving operation.

It is another object of the invention to reduce the wear in a projectile guide due to the sliding of a projectile therethrough.

Briefly, the invention provides a projectile guide for a weaving machine which is comprised of a plurality of longitudinally aligned and spaced apart support teeth and a plurality of guide teeth disposed in alternating relation with the support teeth. In accordance with the invention, each support tooth has at least one horizontally disposed support surface for slidably receiving and supporting a picking projectile thereon. In addition, each guide tooth is provided with guide surfaces for preventing a picked projectile from sliding laterally off the support surface of the support teeth during picking.

The construction of the projectile guide is such that there is reduced friction between the projectile and the teeth of the guide. In addition, there is less risk of a warp yarn catching inside of a guide or support tooth. Accordingly, weaving can proceed with less coolant being supplied to a weft tunnel defined by the support teeth and guide teeth and with fewer stoppages due to damage of the warp.

In one embodiment, each support tooth includes an inclined surface defining a lateral guide on one side of the support surface in order to prevent lateral sliding of a picked projectile from the support surface. In addition, each guide tooth has a guide surface defining a lateral guide on an opposite side of the support surface of an adjacent support tooth in order to prevent lateral sliding of a picked projectile thereat. Further, each guide tooth has a horizontally disposed guide surface in a plane above the support surface of an adjacent support tooth in order to limit lifting of a picked projectile from the support surface of the adjacent tooth.

The guide surfaces of the projectile guide which act laterally or downwardly on a projectile are operative merely to deflect the projectile into the required direction in the event the projectile deviates from a path dead parallel to the weft tunnel. In the case of previously known projectile guides, the lateral guide surfaces serve to support the projectile. Consequently, the clearance between the guide surfaces of the projectile guide and a projectile can be considerably greater than in previously known guides. When the projectile is guided dead parallel to the weft tunnel before entering the tunnel, the only contact between the guide surfaces and the projectile is by way of the horizontal support surface of a support tooth.

Figure 4:
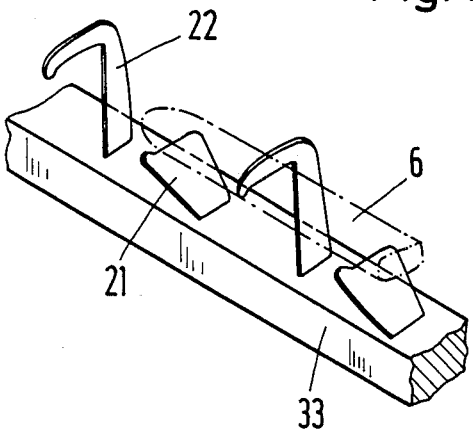
Figure 2C:
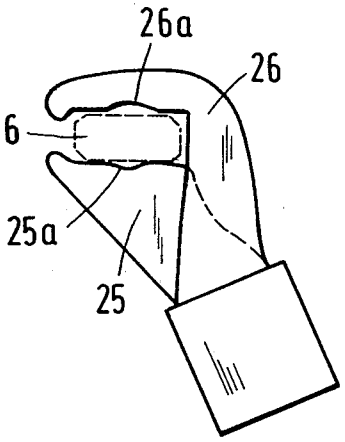
Figure 2B:
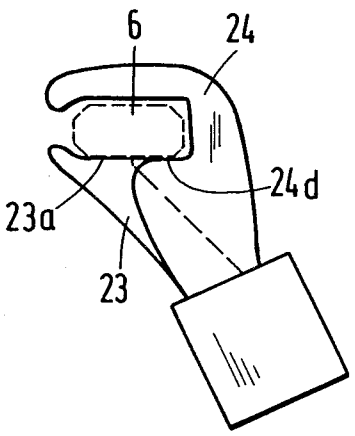
Figure 2A:
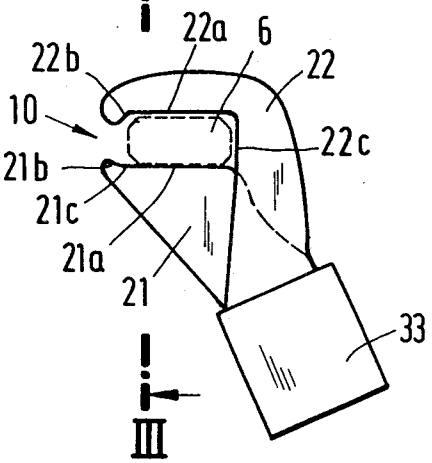
Figure 2E:
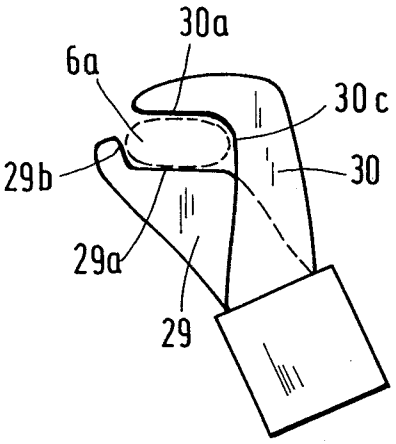
Figure 2F:
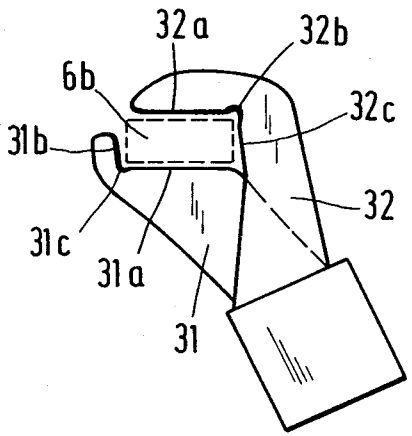
Figure 2D:
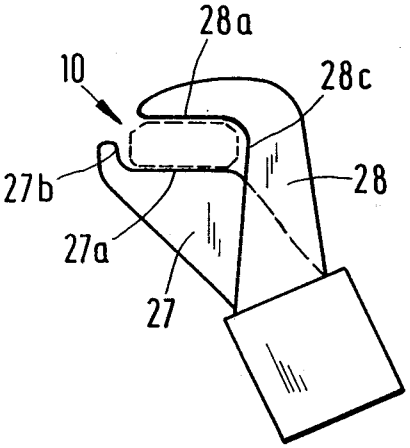
Figure 3A:
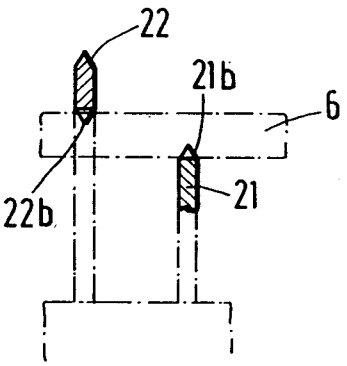
Figure 3B:
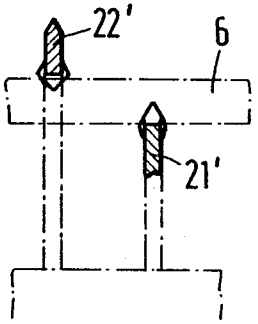
Figure 3C:
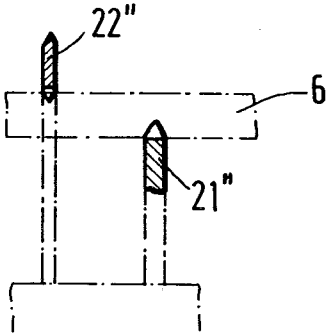

These and other objects and advantages of the invention will become more apparent from the following detailed description taken in conjunction with the accompanying drawings wherein:

FIG. 1 illustrates a view in a picking direction of a previously known projectile guide;

FIG. 2*a* illustrates view of a projectile guide constructed in accordance with the invention and taken in a picking direction;

FIG. 2*b* illustrates a view similar to FIG. 2*a* of a modified projectile guide in accordance with the invention;

FIG. 2*c* illustrates a view similar to FIG. 2*a* of a further modified projectile guide;

FIG. 2*d* illustrates a view similar to FIG. 2*a* of a further modified projectile guide employing a lateral guide on one side of a support tooth in accordance with the invention;

FIG. 2*f* illustrates a view similar to FIG. 2*a* of a projectile guide for a projectile of rectangular cross sectional shape in accordance with the invention;

FIG. 2*e* illustrates a view similar to FIG. 2*a* of a modified projectile guide for a projectile having curvilinear surfaces;

FIG. 3*a*illustrates a view taken on line III—III of FIG. 2*a*:

FIG. 3*b* illustrates a view similar to FIG. 3*a* of a modified projectile guide in accordance with the invention;

FIG. 3*c* illustrates a view similar to FIG. 3 of a further modification of a projectile guide in accordance with the invention; and FIG. 4 illustrates a part perspective view of a projectile guide constructed in accordance with the invention.

Referring to FIG. 1, the weaving machine includes a sley 1 which carries a reed 2 via a sley section 3 on a sley lever 4 which is disposed on an oscillation shaft (not shown) which oscillates about a pivot axis (not shown). In addition, a guide for a picking element 6, for example in the form of a gripper projectile, is mounted on the sley section 3. As indicated, the guide is formed of a plurality of aligned teeth 15 which are disposed at regular intervals along the sley section 3 and define a weft tunnel for the projectile 6 for the picking of a weft yarn 7 into a shed formed by warp yarns in the warp planes 8, 9. After picking, the teeth 15 descend to the right, as viewed, the leave the shed with the weft 7 issuing to the left, as viewed, through a funnel-shaped opening 10 in the teeth 15. Subsequently, with the sley 1 in the chain-dotted-line position in FIG. 1, the weft yarn 7 is beaten up into a cloth 11.

The construction of the weaving machine is generally known and need not be described.

Referring to FIG. 2*a*, the projectile guide of the invention includes a plurality of longitudinally aligned and spaced apart support teeth 21 and guide teeth 22 which are disposed in alternating relation with the support teeth 21 over the whole width of the cloth. As indicated, the teeth 21, 22 are mounted in a suitable holder 33 and serve to define a weft tunnel for the projectile 6. Of note, the projectile 6 may also be in the form of a rod or other known picking element.

Each support tooth 21 has a horizontally disposed support surface 21*a* for slidably receiving and supporting the picked projectile 6 thereon. In addition, each support tooth 21 has an inclined surface 21*b* which defines a lateral guide on one side of the support surface. As indicated, the inclined surface 21*b* extends from the horizontal surface 21*a* at a point 21*c*.

Each guide tooth 22 has a horizontally disposed guide surface 22*a* in a plane above the support surface 21*a* of the adjacent support tooth 21 in order to limit lifting of a picked projectile 6 from the support surface 21*a*. In addition, each guide tooth 22 has an inclined guide surface 22*b* on one side of the horizontal surface 22*a* and a guide surface 22*c* defining a lateral guide on an opposite side of the support surface 21*a* of an adjacent support tooth 21 in order to prevent lateral sliding of a picked projectile 6 from the support surface 21*a*.

As shown in FIG. 2*a*, the inclined surfaces 21*b*, 22*b* are spaced apart to define an opening 10 on the reed side of the guide in order to permit exit of a weft yarn after picking. In addition, at least one of the inclined surfaces 21*b*, 22*b* serves as a lateral guide for the projectile 6 on this side of the guide. In this case, the inclined surface which is closest to the projectile 6 serves as the guide surface.

During normal weaving, the projectile 6 should not touch the top horizontal guide surface 22*a* of the guide tooth 22. Consequently the horizontal guide surface 22*a* is spaced a greater distance above the plane of the horizontal support surface 21*a* of the adjacent support teeth 21 which is greater than the height of the projectile 6.

During a picking operation, the projectile guide is positioned within the shed, for example as illustrated in FIG. 1 such that the support surface 21*a* of each support tooth 21 is in a horizontal plane. Thus, the weight of the projectile 6 is directly supported on the support surfaces 21*a*. Should there be any vibration by the sley, the laterally disposed guide surfaces 21*b*, 22*b*, 23*c* serve to deflect the projectile 6 back towards the weft tunnel and thus prevent a sliding of the projectile 6 from the support surfaces 21*a*.

Referring to FIG. 2*b*, the projectile guide may be modified so that the guide tooth may take on some of the weight of a projectile 6. To this end, the guide tooth 24 is provided with a horizontally disposed support surface 24*d* which is in co-planar relation with the horizontal support surface 23*a* of an adjacent support tooth 23 in order to slidably receive and support a portion of the picked projectile 6. The remainder of the construction of the guide is similar to that as described with respect to FIG. 2*a* except that the horizontal support surface 23*a* of the support tooth 23 is shorter than in the case of the support tooth 21 of FIG. 2*a*. The advantage of this construction is that, in the case of an inclined position, a warp yarn can slide over the support tooth 23 better towards the holder 33.

Referring to FIG. 2*c*, the projectile guide may have a trough 25*a* disposed in the horizontal support surface of the support tooth 25 as well as a trough 26*a* in the horizontal guide surface of the guide tooth 26. This feature is advantageous for some yarns which require a relatively large amount of lubricant to be injected into the weft tunnel since the troughs and the projectile help to make distribution more uniform over the whole of the cloth width.

Referring to FIG. 2*d*, each support tooth 27 may be provided with an upstanding lateral guide 27*b* at the weft yarn exit side 10 of the horizontal support surface 27*a*. In this case, the lateral guide 27*b* provides a substantially vertical guide surface to prevent lateral sliding of the projectile from the horizontal support surface 27*a*. In addition, each guide tooth 28 is provided with a top horizontal guide surface 28*a* and a lateral guide surface 28*c*. However, the top horizontal guide surface 28*a* terminates at the weft yarn exit side 10.

The projectile guides illustrated in FIGS. 2*a*, 2*d* are particularly suitable for projectiles or picking elements which have three plane lateral surfaces. For projectiles having more developed surfaces, the guide may be adapted with corresponding surfaces.

For example, referring to FIG. 2*e* for a projectile having cylindrical side surfaces, the support teeth 29 and guide teeth 30 may be provided with respective cylindrical guide surfaces 29*b*, 30*c*which are laterally adjacent the horizontal support surface 29*a* and top horizontal guide surface 30*a*, respectively.

Referring to FIG. 2*f*, wherein the projectile 6*b* has a rectangular cross-section, the guide teeth 31 is provided with a relieved zone 31*c* between a horizontal support surface 31*a* and lateral guide 31*b* whereas each guide tooth 32 is provided with a relieved zone 32*b* between the top horizontal guide surface 32*a* and lateral guide surface 32*c*, as shown.

Referring to FIG. 3*a*, the support teeth 21 and guide teeth 22 are provided with pointed ends on the projections of the lateral guide surfaces 21*b*, 22*b*. Thus, when passing into a warp plane, the warp yarns can be more easily set to the sides of the respective teeth in order to reduce the risk that a warp yarn may catch on a projection.

Referring to FIG. 3*b*, the support teeth 21' and the guide teeth 22' may also be provided with thickenings as indicated at the projections of the lateral guide surfaces. The effect of the thickenings is that when the teeth enter the shed, there is a better division of the bottom warp plane. This further reduces the risk of an inclined warp yarn catching in the teeth.

Referring to FIG. 3*c*, the guide teeth 22'' may be of less thickness than the thickness of the adjacent support teeth 21''. This feature is particularly convenient where the guide teeth do not have any support functions.

Advantageously, for a very substantial reduction in the transmission of vibrations of the sley around the sley pivot point to the projectile, the horizontal support surface 21*a*, 23*a*, . . . 31*a* is slightly convex with a center of curvature disposed for positioning on the center of rotation of the sley, i.e. the pivot point of the sley.

Referring to FIG. 4, the spacing of the support teeth 21 and guide teeth 21 is such that the projectile 6 extends across three teeth. For example, in the position illustrated, the projectile 6 is supported on two support teeth 21 whle being guided by one intermediately disposed guide tooth 22. Of course, as the projectile proceeds, the projectile would subsequently be supported on one support tooth 21 while being guided by two guide teeth 22.

The invention thus provides a projectile guide for a weaving machine wherein the weight of a picked projectile can be readily supported on a horizontal support surface while the projectile is prevented from laterally straying from the support surface. Thus, the amount of friction generated by the projectile during picking on the guide teeth is reduced with a subsequent reduction in wear of the guide. In addition, because of the reduction in friction forces, the amount of heat generated by such forces is reduced so that the need for lubricant or coolant on the teeth can be reduced to a minimum.

What is claimed is:

1. A projectile guide for a weaving machine comprising a plurality of longitudinally aligned and spaced apart support teeth, each said tooth having at least one horizontally disposed support surface for slidably receiving and supporting a picked projectile thereon during travel of the projectile in a picking path; and a plurality of longitudinally spaced apart guide teeth disposed in alternating relation with said support teeth, each said guide tooth having guide surfaces spaced from a projectile passing thereby in said picking path for preventing a picked projectile from sliding laterally of said picking path and off said support surfaces of said support teeth during picking.

2. A projectile guide as set forth in claim 1 wherein each guide tooth includes an inclined surface defining a lateral guide on one side of a respective support surface to prevent sliding off of a projectile thereat.

3. A projectile guide as set forth in claim 1 wherein at least one of said guide teeth includes a horizonally disposed support surface in co-planar relation with said support surface of an adjacent support tooth to slidably receive and support a portion of a picked projectile thereon.

4. A projectile guide as set forth in claim 1 wherein each guide tooth has a cylindrical guide surface laterally adjacent said support surface of an adjacent support tooth for guiding a projectile having a correspondingly shaped side wall.

5. A projectile guide as set forth in claim 1 wherein each guide tooth is of less thickness than the thickness of an adjacent support tooth.

6. A projectile guide as set forth in claim 1 wherein said support surface is slightly convex with a center of curvature disposed for positioning on a center of rotation of a sley mounting said projective guide.

7. A projectile guide for a weaving machine comprising a plurality of longitudinally aligned and spaced apart support teeth, at least some of said teeth having a horizontally disposed support surface for slidably receiving and supporting a picked projectile thereon during travel of the projectile in a picking path and an inclined surface defining a lateral guide on one side of said support surface spaced from a projectile in said picking path to prevent lateral sliding of a picked projectile from said support surface; and a plurality of guide teeth disposed in alternating relation with said support teeth, at least some of said guide teeth having a guide surface defining a lateral guide on a opposite side of said support surface of an adjacent support tooth spaced from a projectile in said picking path to prevent lzteral sliding of a picked projectile from said respective support surface thereat and ahorizontally disposed guide surface in a plane above said support surface of an adjacent support tooth and spaced from a projectile in said picking path to limit lifting of a picked projectile from said support surface of an adjacent support tooth.

8. A projectile guide as set forth in claim 7 wherein at least one of said guide teeth includes horizontally disposed support surface in co-planar relation with said support surface of an adjacent support tooth to slidably receive and support a portion of a picked projectile thereon.

9. A projectile guide as set forth in claim 7 wherein each guide tooth is of less thickness than the thickness of an adjacent support tooth.

10. A projectile guide as set forth in claim 7 wherein said support surface is slightly convex with a center of curvation disposed for positioning on a center of rotation of a sley mounting said projective guide.

* * * * *

UNITED STATES PATENT AND TRADEMARK OFFICE

CERTIFICATE OF CORRECTION

PATENT NO. : 4,653,545

DATED : March 31, 1987

INVENTOR(S) : Peter ~~XXXX~~ Riesen

It is certified that error appears in the above—identified patent and that said Letters Patent is hereby corrected as shown below:

Column 2, line 57 "illustrates" should be -illustrates a-
Column 3, line 7 "3 a illustrates" should be -3a illustrates-
Column 3, line 30 "the leave" should be -then leave-
Column 4, line 61 "30cwhich" should be -30c which-
Column 4, line 65 "teeth 31 is" should be -teeth 31 are-
Column 5, line 29 "teeth 21" should be -teeth 22-
Column 6, line 40 "a" should be -an-
Column 6, line 42 "lzteral" should be -lateral-
Column 6, line 44 "ahorizontally" should be -a horizontally-
Column 6, line 51 "includes horizontally" should be -includes a horizontally-

Signed and Sealed this

Thirteenth Day of October, 1987

*Attest:*

DONALD J. QUIGG

*Attesting Officer*

*Commissioner of Patents and Trademarks*